United States Patent [19]

Ernst et al.

[11] 4,343,144

[45] Aug. 10, 1982

[54] CONTROL ARRANGEMENT FOR A TEXTILE MACHINE

[75] Inventors: Walter Ernst, Weinfelden; Hans Giger, Riedt; Ernst Sigrist, Turbenthal, all of Switzerland

[73] Assignee: Rieter Machine Works Ltd., Winterthur, Switzerland

[21] Appl. No.: 234,259

[22] Filed: Feb. 13, 1981

[30] Foreign Application Priority Data

Feb. 28, 1980 [CH] Switzerland ..... 1584/80

[51] Int. Cl.[3] ..... D01H 13/16

[52] U.S. Cl. ..... 57/86; 57/81; 57/288; 57/310

[58] Field of Search ..... 57/80, 81, 86, 87, 287, 57/288, 310

[56] References Cited

U.S. PATENT DOCUMENTS

| | | | |
|---|---|---|---|
| 2,555,219 | 5/1951 | Batey | 57/86 |
| 3,034,278 | 5/1962 | Kay et al. | 57/86 |
| 3,102,378 | 9/1963 | Walker, Jr. | 57/81 |
| 3,272,048 | 9/1966 | Archer | 57/81 |
| 3,314,225 | 4/1967 | Batey | 57/81 |
| 3,568,425 | 3/1971 | Zegna et al. | 57/81 |
| 3,643,883 | 2/1972 | Wuest | 57/86 X |
| 3,747,314 | 7/1973 | Kilduff | 57/86 X |

*Primary Examiner*—John Petrakes

*Attorney, Agent, or Firm*—Werner W. Kleeman

[57] ABSTRACT

The control arrangement is used in conjunction with a textile machine at which a thread or a filament, respectively, supplied from a creel package is guided via a roll, around which it forms a plurality of windings, to a thread guide eyelet and to a ring spindle system. The invention aims at the reliable elimination of any danger of lap-up formation on the roll including the danger of lap-up formation caused by unwinding the thread from a take-up bobbin (unwinding "overhead" from the take-up bobbin). The control arrangement comprises a first thread severing element which severs the thread upstream from the roll, and a second thread severing element which severs the thread along the unwinding path between the roll and the take-up bobbin. The control arrangement further comprises a thread feeler which is designed with a slot and which can release the thread in a plane at substantially right angles to the roll axis of the roll, and a control device for activating the thread severing elements and the thread feeler.

6 Claims, 4 Drawing Figures

CONTROL ARRANGEMENT FOR A TEXTILE MACHINE

BACKGROUND OF THE INVENTION

The present invention relates to a new and improved control arrangement for a textile machine equipped with at least one roll and a ring spindle system, wherein a thread along its path of travel from a creel package to a take-up bobbin placed on the spindle first is wound around the cylindrical surface of the roll in at least one wrap, and subsequently is guided via a thread guide eyelet arranged coaxially with respect to the spindle to the ring spindle system.

In transporting endless filaments or the like, hereinafter referred to as threads, as a rule a substantial portion of a draw roll or a separator or deflecting roll, designated as roll in the following description, is covered. It occurs relatively frequently that following a thread breakage the thread tends to stick to the roll surface due to static friction. If the thread breakage occurs between the roll and the spindle arranged downstream therefrom, the thread which is still taken off from the creel package is wound onto the roll surface, which causes a disturbing lap-up formation thereon, adversely affecting the operation of the equipment. If the thread breakage, on the other hand, occurs upstream of the roll, i.e. between the creel package and the roll it frequently occurs that the "running out" thread tail does not leave the roll surface but is entrained thereby, in such a manner that the thread is wound onto the roll in the reverse direction of movement. Since a ring spindle system is arranged downstream of the roll, from which system the thread can be taken off overhead from the bobbin, also in this case a lap-up is formed on the roll, the formation of which theoretically does not cease until the entire take-up bobbin package placed onto the spindle is unwound.

Control arrangements already are known to the art which aim at eliminating the adverse effects of such lap formations in such a manner that if a thread breakage is detected, the thread supply from the creel package is stopped. Thus, a prior art lap-up control device is disclosed in German Pat. No. 1,940,272, in which the formation of a lap-up on a roll is detected by using a feeler designed as a lever. This lever is placed close to the roll surface and directed towards the roll surface. In this arrangement upon activation of the feeler a cutter arranged upstream from the roll stops the thread supply.

This control device is associated with some considerable disadvantages which render impossible its application on a textile machine equipped with a ring spindle system, such as for instance a draw-twisting machine or a draw-texturing-twisting machine. The control device permits detection of lap-up formations on the roll, independent of whether such are caused by thread originating from the creel package or taken off overhead from the take-up bobbin. However, such control device requires that there already has occurred the formation of a lap-up of a minimal thickness, so that there is always required a cleaning operation for elimination of the lap-up from the roll. Furthermore, this known control device is not capable of effectively counteracting lap-up formations caused by take-off of the thread from the take-up bobbin, since although it can detect the lap-up, it cannot interrupt its continued formation. The lap-up thus increases in size, and there is created a great danger of damage to the working elements of the machine.

According to the German Patent Publication No. 1,535,034 also application of a device for interrupting the thread movement in a textile machine is known to the art, in which device in case of a thread breakage between the drawing arrangement or the supply arrangement, respectively, and the spindle (detected by a feeler contacting the thread between the drawing arrangement or the supply arrangement, respectively, and the spindle), an electric heating element provided in the vicinity of the thread path, for severing the thread, severs the thread from its supply to the drawing arrangement or the supply arrangement, respectively. Also this device shows the disadvantage that the lap-up formations caused by unwinding the thread overhead from the take-up bobbin are not detected and cannot be avoided. The danger of lap-up formation thus still prevails.

Also according to the already known proposal disclosed in Swiss Pat. No. 528,257, in which for detecting a thread breakage, there is accomplished scanning of the rotation of the traveller on the ring using a contact-free traveller feeler, the above-mentiioned danger of thread take-off overhead from the take-up bobbin cannot be eliminated with sufficient reliability, since also in this case the thread can remain threaded in the traveller, so that the traveller continues to rotate on the ring.

SUMMARY OF THE INVENTION

It thus is an important object of the present invention to eliminate the above-mentioned disadvantages of the state of the art in an arrangement of the type mentioned above, and, in particular, to achieve immediate prevention of any lap-up formation on the roll, not only in case of a thread breakage between the roll and the spindle, but also in case of a thread breakage between the creel package and the roll.

Stated in another way it is a further significant object of the present invention to also eliminate completely the danger of thread unwinding overhead from the take-up bobbin placed onto the spindle, and to achieve this by using a simple and economically feasible and operationally reliable arrangement.

Now in order to implement these and still further objects of the invention, which will become more readily apparent as the description proceeds, the inventive control arrangement comprises a first thread severing element, which viewed in the direction of thread movement, is arranged upstream of the roll and upon activation severs the thread passing between the creel package and the roll. A second thread severing element is provided which is arranged in the immediate vicinity of the thread guide eyelet and upon activation severs the thread which is being unwound from the take-up bobbin on the roll between the roll and the take-up bobbin. There is also provided a thread feeler, shaped as an open slot, arranged in the thread path of the thread running normally between the roll and the thread guide eyelet. The slot can release the thread in a plane substantially perpendicular with respect to the roll axis, and such slot is open on the side facing the roll. A control device serves for effecting the activation of both thread severing elements in the absence of a thread in the thread feeler.

The control arrangement construction wherein the second thread severing element is also designed as thread guide eyelet is particularly advantageous in that, owing to the integration of the second thread severing element with the thread guide eyelet, there is obtained a very simple arrangement.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figures 1, 2:
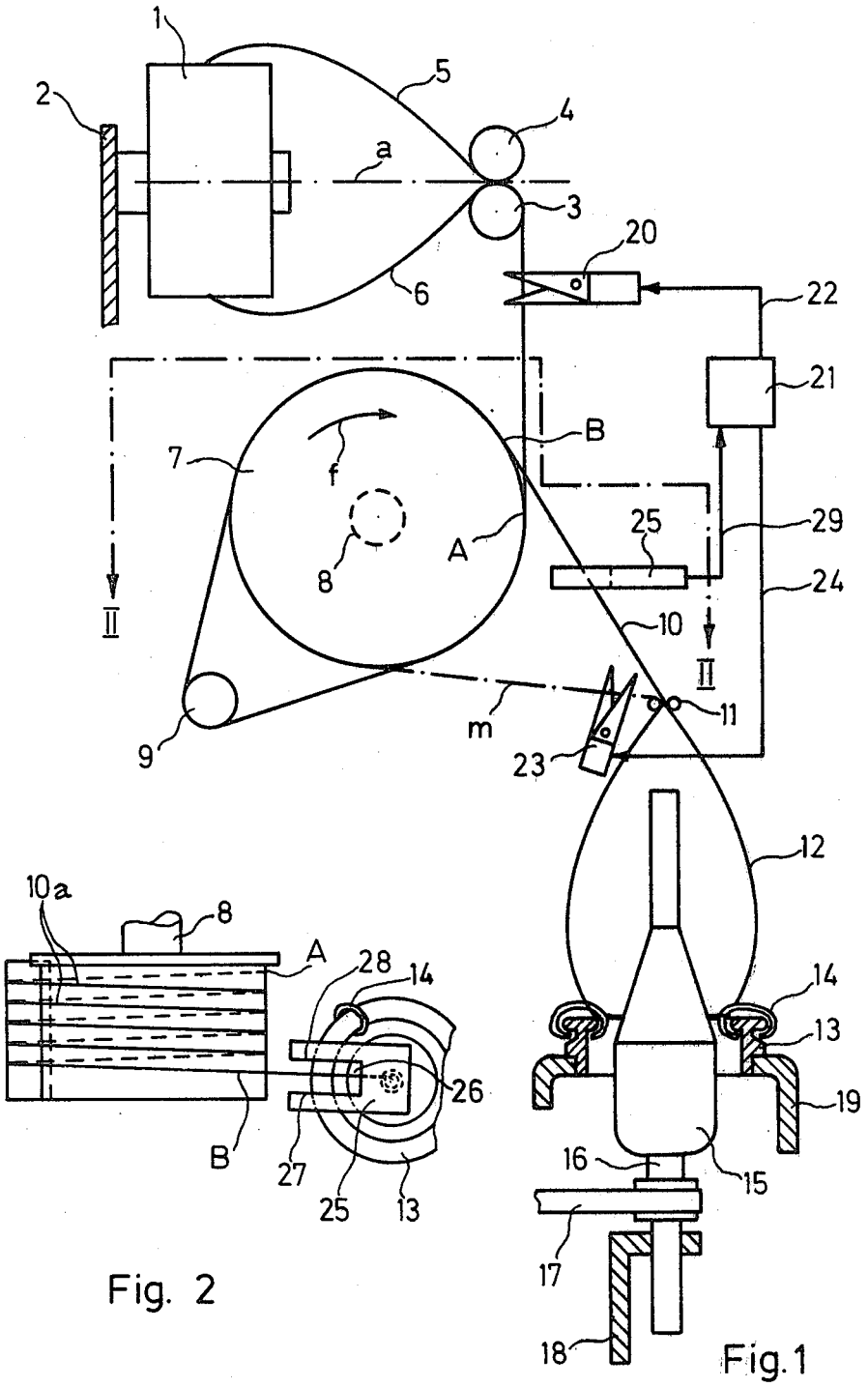
FIG. 1 is a schematic view of the inventive control arrangement in a draw-twisting machine.
FIG. 2 is a sectional view taken substantially along line II—II of the arrangement according to FIG. 1.

Describing now the drawings, in FIG. 1, which shows the working elements of a processing position of a draw-twisting machine, the creel package 1 is placed on a creel 2, merely indicated schematically of the machine, from which creel package 1 there is removed an undrawn filament 5. Unwinding of the filament 5 from the creel package 1 is effected, in the example illustrated, in such a manner that the nip point of the filament 5 between the delivery or supply rolls 3 and 4 is located substantially on the axis a of the bobbin or creel package 1. This type of unwinding is called "overhead" unwinding, and is characterized in that the thread to be unwound forms a balloon 6 about the bobbin package 1. The package in this arrangement can remain stationary, which represents the major advantage of the "overhead" unwinding, or can be rotated about its axis a. In both cases "overhead" unwinding is possible, the only difference between the two cases being the number of twist turns inserted in the thread downstream of the delivery or supply rolls 3 and 4. These explanations merely clarify the term "overhead" unwinding which, in the context of the present invention, is of decisive importance. In the context of the present invention, however, it is of no consequence, whether the creel package is unwound "overhead" or unwound by unrolling. The supply rolls 3 and 4 supply the thread to a draw roll 7, which rotates with a driven shaft or axis 8 (see also FIG. 2) supported in the machine. A separator or deflecting roll 9 arranged substantially parallel with respect to the shaft or axis 8 of the draw roll 7 cooperates in known manner with the roll 7. The thread now is placed in a plurality of wraps 10*a* (FIG. 2) around the draw roll 7 and the separator or deflecting roll 9 and on the surface of the roll 7 forms a helical curve extending in FIG. 2 from the top to the bottom between the contact point A of the incoming thread (see also FIG. 1) and the leaving or departure point B (see also FIG. 1). Along the path between the pair of supply rolls 3 and 4 and the contact point A the thread is drawn owing to the speed difference. From the departure point B the now drawn thread 10 is transferred to a thread guide eyelet 11. From there the thread, forming a thread balloon 12 and passing through a traveller 14 circling on a ring 13, is wound onto a rotatingly driven take-up bobbin 15. The take-up bobbin package is placed onto a spindle 16, which through the use of suitable means (e.g. using a belt 17 as indicated in FIG. 1) is rotatably driven. The winding mechanism of a ring spindle system is assumed to be sufficiently known, and thus is not described in more detail in this context. It is to be noted, that the spindle rail is designated by reference character 18 and the ring rail by reference character 19, and that the arrow f indicates the direction of rotation of the draw roll 7.

If in an arrangement of this type no control or monitoring elements are provided, it may occur that the supplied thread e.g. brakes upstream from the draw roll 7 or is absent if the creel bobbin package 1 is exhausted. In this case the thread tail end running out would move on the roll surface up to the departure or exit point B and then would leave the roll 7 and would be transported through the thread guide eyelet 11 to the take-up bobbin package 15. Unfortunately, however, the winding sequence of the free end, which no longer is tightly guided, is not always effected correctly as described above, but time and again the tailing thread end clings to the surface of the roll 7, due to various reasons, and is entrained thereby. In this case the thread then is carried into the position indicated in FIG. 1 with dash-dotted lines, which corresponds to the unwinding path m, the thread 10 thus no longer passing along the path from the roll 7 to the take-up bobbin 15, but passing along the reverse path from the take-up bobbin 15 to the roll 7 via the thread guide eyelet 11. The thread thus changes its direction of movement and, while forming a ballon 12, is unwound "overhead" from the take-up bobbin 15. The material unwound is now wound onto the surface of the draw roll 7 in the form of a disturbing lap-up, and this unwinding process theoretically continues until the whole take-up bobbin package 15 is emptied completely. In most cases, particularly if the take-up bobbin 15 contains a great deal of material, this causes great operational difficulties, which are effectively countered according to the present invention using a particular arrangement of the control or monitoring elements.

For this purpose a first thread severing element 20 is provided upstream, as viewed in the direction of thread movement, of the draw roll 7. This element 20, indicated in FIG. 1 e.g. as scissors, is capable of severing the thread between the creel package 1 and the draw roll 7 in suitable manner (e.g. by mechanically severing or cutting, respectively, by severing using elevated temperature, etc.), and such thread severing element 20 is activated by a control device 21 via the line or circuit 22 and is controlled in a manner to be explained more fully hereinafter. A further thread severing element 23, the design of which can be chosen e.g. exactly the same as that of the above-mentioned thread severing element 20, is placed in the immediate vicinity of the thread guide eyelet 11 in such a manner that it is capable of severing the thread between the draw roll 7 and the spindle 16 (or the take-up bobbin package 15, respectively) in the event that thread follows the unwinding path m. The thread severing element 23 thus intersects the unwinding path m. Also this thread severing element 23 is controlled using the control device 21 via the line or circuit 24 in suitable manner. In this arrangement control of the thread severing elements 20 and 23 can be effected, according to the type of elements chosen, electrically, pneumatically, hydraulically, etc. The line or circuits 22 and 24 thus accordingly can be of various types, and also the control device 21 is adapted in its functions to the chosen type of thread severing elements 20 and 23.

Furthermore, there is provided in the thread path of the normally running, extended thread 10, between the draw roll 7 and the second thread severing element 23, a thread feeler 25 which contains an open slot 26 (FIG. 2). The location of the slot 26, within the scope of the present invention, is of decisive importance: the slot 26 must be capable of releasing the thread 10 in a plane which is substantially disposed at right angles with respect to the roll shaft or axis 8, and the thread release is to be effected from the side facing the roll 7. This implies that the slot 26 is open at the side facing the roll 7, i.e. as shown in FIGS. 1 and 2 towards the left-hand side. The above-mentioned conditions as to the release of the thread 10 means that each of the two flanks or sides 27 and 28 of the slot 26 are arranged substantially in a plane perpendicular to the roll axis 8. The position of the thread feeler 25 in this arrangement is chosen such that a thread passing along the dash-dotted unwinding path m with utmost certitude no longer can be detected by the thread feeler 25. It thus is recommended to place the thread feeler 25 at a sufficient distance from the thread guide eyelet 11.

The type of thread feeler 25 or its mode of operation or function, respectively, within the scope of the present invention can be chosen as desired: most suitably thread feelers functioning without contact are used (e.g. of the optical or capacitive type or equivalent operating feelers) as they do not disturb the normal thread passage: but also mechanically operating feelers (not shown) are entirely suitable, if they fulfil the above-mentioned conditions as to the release of the thread 10.

The thread feeler 25 is connected with the control device 21 via a line or circuit 29. Also this line or circuit 29, according to the type of thread feeler 25 which has been chosen, can be an electric, a pneumatic, a hydraulic, a mechanical one, and so forth. The control elements 21, 22, 24 and 29 according to the invention are to fulfil only one condition, namely that in case of absence of a thread in the thread feeler 25 (i.e. if the latter no longer detects a thread 10 in the zone of its slot 26) both thread severing elements 20 and 23 are activated via the lines or circuits 22 and 24 and effect the severing of the thread at both of the provided locations. A control of this type for the control or work elements 20, 23 and 25, and the circuits required in the control device 21 are known to those skilled in the art, and thus, do not here require any further description.

Figure 3:
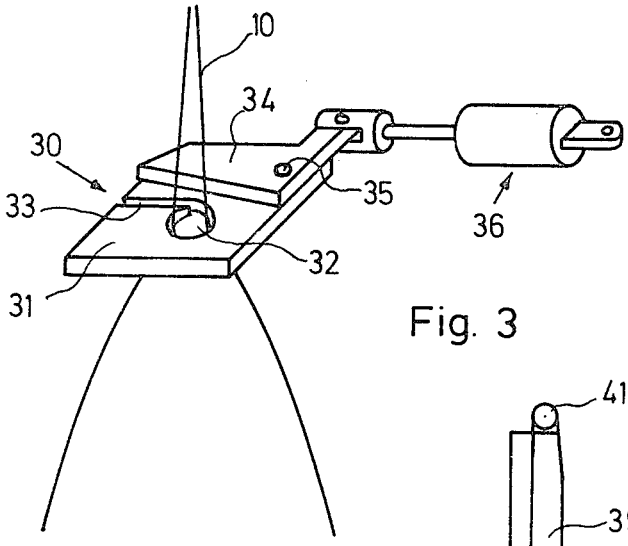
FIG. 3 illustrates an alternative design of a detail of the arrangement according to FIGS. 1 and 2.

The second thread severing element 23 and the thread guide eyelet 11 arranged in its immediate vicinity in the arrangement according to FIGS. 1 and 2, advantageously, as shown in FIG. 3, can be combined into one single thread severing element 30. This consists e.g. of a lower plate 31, wherein a suitable bore 32 defining a thread guide eyelet is provided with a threading-in slot 33, and a cutter or knife 34 is arranged pivotable about an axis or pivot shaft 35 on the plate 31. For the cutting operation such cutter or knife 34 can be pivoted by using a suitable piston and cylinder unit 36. As the cutter or knife 34 is pivoted, the thread 10 passing via the thread guide eyelet is severed between the upper edge of the bore 32 and the lower front edge of the cutter or knife 34.

The solution shown here of the combination of a thread guide eyelet with a thread severing device, which has been indicated here merely as an example of many other imaginable alternative embodiments, possesses the advantage of simplicity.

Figure 4:
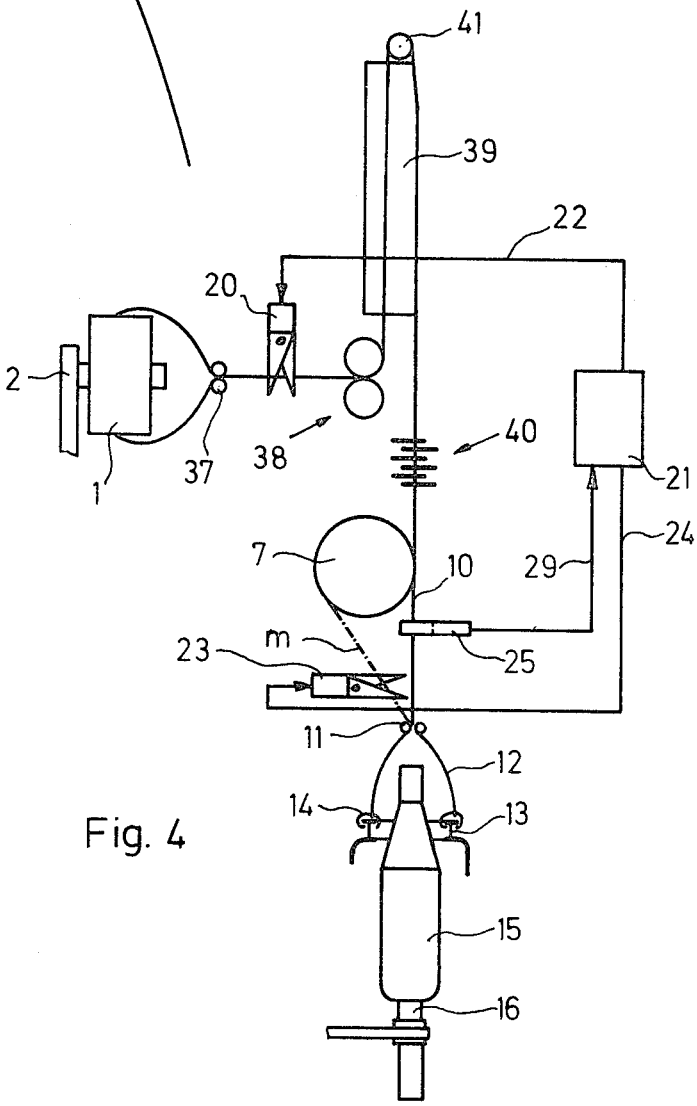
FIG. 4 illustrates the inventive control arrangement, also in schematic view, in a draw-texturing-twisting machine.

In FIG. 4 furthermore there is shown the application of the inventive arrangement in a draw-texturing-twisting machine, and it is to be understood that elements the same as or analogous to those in the arrangement according to FIGS. 1 and 2 have been conveniently designated by the same reference numbers. Other than in the arrangement according to FIGS. 1 and 2, the thread in this machine not only is subject to a drawing process, but also is subject to a texturing process under elevated temperature. The thread path from the creel package 1 to the spindle 16 or to the take-up bobbin 15, respectively, in this arrangement thus is considerably longer and more complicated. In FIG. 4, in which a draw-texturing-twisting machine for the so-called simultaneous draw-texturing method has been schematically shown, the machine comprises, as seen in the direction of thread travel or transport, a first thread guide 37, a delivery or supply device 38 containing two rolls, a heater 39 in which the thread is heated, e.g. under contact, to a certain temperature, a false twisting device 40 (e.g. in the form of a multiple disc false twisting device), by means of which a false twist is imparted to the thread between the twist-stop-roll 41 and the false twisting device 40, a draw roll 7 onto which the thread is wrapped in several windings, and which is capable of maintaining the thread in the texturing zone under tension by drawing it out (wherefore, as the thread is textured while being drawn, the process is called simultaneous draw-texturing), and finally the thread guide eyelet 11 with the balloon 12 and the ring 13 with the traveller 14. The arrangement of the elements downstream of the draw roll 7 corresponds exactly to the arrangement according to FIGS. 1 and 2, and also the object to be achieved, i.e. the elimination of the danger of unwinding thread from the take-up bobbin 15, is the same as in the above-described arrangement. The arrangement of the second thread severing element 23 and the thread feeler 25 corresponds exactly to the one shown in FIGS. 1 and 2: only the first thread severing element 20 is arranged in the direction of thread movement, other than in the arrangement shown in FIG. 1 immediately upstream from the draw roll 7, but here instead upstream from the above-described working elements 38 through 41. The thread severing element 20 thus, upon activation, severs the thread immediately after the creel package 1. According to the invention, however, it is irrelevant at which exact location the first thread severing element is placed along the thread path: it must merely be capable of severing the thread upstream of the draw roll 7.

Also in this arrangement the thread severing elements 20 and 23 and the thread feeler 25 are connected via the respective lines or circuits 22, 24 and 29 with the control device 21, and control of the thread severing elements 20 and 23 is effected exactly in the same manner as in the arrangement according to FIGS. 1 and 2. Also in FIG. 4 the thread path m indicates the path, along which the thread would move if unwound from the take-up bobbin 15, if this would not be prevented through the provision of the inventive arrangement.

The arrangements according to FIGS. 1 and 2, or FIG. 4, respectively, function as follows:

If for any reason (e.g. because a thread breakage has occurred between the creel package 1 and the draw roll 7, or because a thread breakage has occurred between the draw roll 7 and the spindle 16 or the take-up bobbin package 15, respectively, and the thread still taken-in from the creel package 1 is wound onto the draw roll 7, or because the creel package 1 has run out and the thread tail end running out did not separate from the surface of the draw roll 7, such that the thread now following the unwinding path m, is unwound from the take-up bobbin package 15) the thread feeler 25 no longer detects any thread running normally between the draw roll 7 and the thread guide eyelet 11, then the thread feeler 25 will transmit a signal in suitable form to the control device 21. The control device 21 immediately effects activation of the two thread severing elements 20 and 23 in such a manner that the thread is severed reliably upstream and downstream from the roll 7, i.e. in such a manner that any lap-formation on the roll 7 is rendered impossible. This reliability according to the invention is achieved in that the thread supply to the roll 7 in both directions, namely from the creel package 1 and from the take-up bobbin 15, if the thread is unwound therefrom, is interrupted.

It is to be noted, furthermore, that the thread severing element 23 is to be located in such a manner that it necessarily severs, if activated, the thread passing along the unwinding path m; it may, however, be arranged in such a manner also, as shown in the alternative design example according to FIG. 3, that it intersects e.g. also the thread path of the normally running thread 10.

The advantages of the inventive control arrangement described are, in addition to the already mentioned high reliability, its easy mountability or retrofitability on textile machines for processing endless filaments already installed, as well as the fact that the lap-up formation is prevented before an actual lap-up has been built up. The described control arrangement advantageously can be applied to draw-twisting machines and to draw-texturing-twisting machines, and in these applications described herein the roll 7 can be a so-called draw roll.

While there are shown and described present preferred embodiments of the invention, it is to be distinctly understood that the invention is not limited thereto, but may be otherwise variously embodied and practiced within the scope of the following claims. Accordingly,

What we claim is:

1. In a control arrangement for a textile machine equipped with at least one roll having a roll axis and a ring spindle system, wherein a thread along its path of travel from a creel package to a take-up bobbin placed onto the spindle first is wound around a substantially cylindrical surface of the roll in at least one wrap, and subsequently the thread is guided via a thread guide eyelet arranged substantially coaxially with respect to the spindle to the ring spindle system, the improvement which comprises:

a first thread severing element which viewed in the direction of thread travel, is arranged upstream of the roll and upon activation of said first thread severing element severs the thread passing between the creel package and the roll;

a second thread severing element arranged at the immediate vicinity of the thread guide eyelet and upon activation of said second thread severing element severs the thread unwound from the creel package onto the roll between the roll and the take-up bobbin;

a thread feeler shaped as an open slot, arranged in the thread path of the thread running normally between the roll and the thread guide eyelet, the slot of said thread guide being capable of releasing the thread in a plane substantially perpendicular to the roll axis, and said slot being open at a side facing the roll; and a control device for effecting activation of both thread severing elements in the absence of a thread in the thread feeler.

2. The control arrangement according to claim 1, wherein:

said second thread severing element is simultaneously structured to constitute a thread guide eyelet.

3. The control arrangement according to claim 1, wherein:

the textile machine is a machine for processing endless filaments.

4. The control arrangement according to claim 3, wherein:

the textile machine is a draw-twisting machine.

5. The control arrangement according to claim 3, wherein:

the textile machine is a draw-texturing-twisting machine.

6. The control arrangement according to claim 4 or 5, wherein:

the roll is a draw roll.

* * * * *